United States Patent [19]

Epstein

[11] 3,999,311

[45] Dec. 28, 1976

[54] FOOTWEAR CONSTRUCTION

[76] Inventor: William H. Epstein, 1201 NE. 191st St., N. Miami Beach, Fla. 33162

[22] Filed: July 28, 1975

[21] Appl. No.: 599,553

Related U.S. Application Data

[63] Continuation-in-part of Ser. No. 554,277, Feb. 28, 1975.

[52] U.S. Cl. ..... 36/100

[51] Int. Cl.[2] ..... A43B 3/24

[58] Field of Search ..... 36/2.5 R, 2.5 C, 2.5 W, 36/51, 54, 100, 101

[56] References Cited

UNITED STATES PATENTS

| | | | |
|---|---|---|---|
| 2,887,795 | 5/1959 | Taicher | 36/2.5 C |
| 3,032,896 | 5/1962 | Weaver | 36/2.5 C |
| 3,037,303 | 6/1962 | Stever | 36/51 |
| 3,533,172 | 10/1970 | Jones | 36/51 |

*Primary Examiner*—Patrick D. Lawson
*Attorney, Agent, or Firm*—Blum, Moscovitz, Friedman & Kaplan

[57] ABSTRACT

A footwear construction is provided having an ornamental member adapted for removable positioning in the instep region of the footwear so that a plurality of said ornamental members may be provided for interchangeable use in connection with a single footwear construction. The ornamental member may be releasably secured to the side portions of the vamp of the footwear construction so as to bridge the instep region or may be releasably secured to the underside of the tongue of the footwear construction.

15 Claims, 12 Drawing Figures

FOOTWEAR CONSTRUCTION

CROSS-REFERENCE TO RELATED APPLICATION

This is a continuation-in-part application to my application Ser. No. 554,277, filed Feb. 28, 1975.

BACKGROUND OF THE INVENTION

Generally speaking, this invention relates to all types of footwear constructions, and in particular, to shoes of the slip-on or blucher moccasin type. In such constructions, the vamp of the footwear construction, that portion enclosing the toe and instep regions of the wearer's foot, are generally formed in two parts, namely a vamp portion or mudguard extending upwardly from the periphery of the sole in the forward region thereof, so as to surround the instep and toe regions of the wearer's foot and a plug or insert secured to the upper periphery of the vamp portion and bridging same so as to enclose the instep and toe regions of the wearer's foot. As taught in my prior U.S. Pat. No. 2,444,640, issued on July 6, 1948 for BLUCHER TYPE SHOE WITH REMOVABLE PLUG, the plug and vamp portions may be removably secured together, thereby permitting the substitution of the plug so as to produce various decorative effects.

As taught in my pending application Ser. No. 554,277, filed Feb. 28, 1975, which is incorporated herein as if fully set forth, further refinements of footwear constructions including removable plugs are taught, including the provision of a single removable plug and a plurality of plug covers releasably secured to the plug by a releasable securing means such as a hook and loop tape fastener. The provision of replaceable plug covers permits the ornamental appearance of the shoe to be varied by the substitution of interchangeable plug covers. Such plug covers are equally applicable to a footwear construction not provided with a removable plug, in which case the plug region is fixably secured to the vamp but is provided with securing means on its supper surface for cooperation with corresponding securing means on the lower surface of the plug cover.

A further source of ornamental design of footwear constructions is the provision of various ornamental members in the instep region of a footwear construction such as simulated buckles, laces, tassels and other ornaments. In my prior application Ser. No. 554,277, provision of such ornamentation fixedly secured to plug covers is taught. However, it has been found that this does not provide the maximum flexibility in available ornamentation, a deficiency cured by providing a single footwear construction having interchangeable ornamental elements which will permit the wearer to create a plurality of ornamental combinations in a single footwear construction.

SUMMARY OF THE INVENTION

Generally speaking, in accordance with the invention, a footwear construction is provided having a sole portion, a counter portion extending substantially upwardly from the rearward periphery of said sole portion, vamp means extending upwardly from the forward peripheral region of the sole portion and defining the instep region of the footwear construction, an ornamental member for overlying the instep region; and means on said vamp means and ornamental member for cooperatively releasably securing the ornamental member to the vamp means, thereby permitting the selective substitution of a plurality of ornamental members.

The vamp means may be provided with a vamp portion extending substantially upwardly from the forwardly peripheral region of the sole portion and plug portion dimensioned to bridge the upper periphery of the vamp portion for defining, at least in part, the instep region of the footwear construction. The ornamental member may be dimensioned for bridging the instep region of said plug member, said means for releasably securing the ornamental member to the vamp means being positioned on said vamp portion.

The vamp means may be provided with a tongue portion defining the instep region of said footwear construction, said ornamental member being dimensioned to bridge the top surface of said tongue portion and to be tucked under the sides of said tongue portion, said means for releasably securing said ornamental member to said tongue portion being positioned on the underside of said tongue portion.

Accordingly, it is an object of the invention to produce a footwear construction having interchangeable ornamental members thereby increasing the decorative effect produceable in said footwear constructions.

Other objects and advantages of the invention will impart the obvious and will impart the apparent from the specification and drawings.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
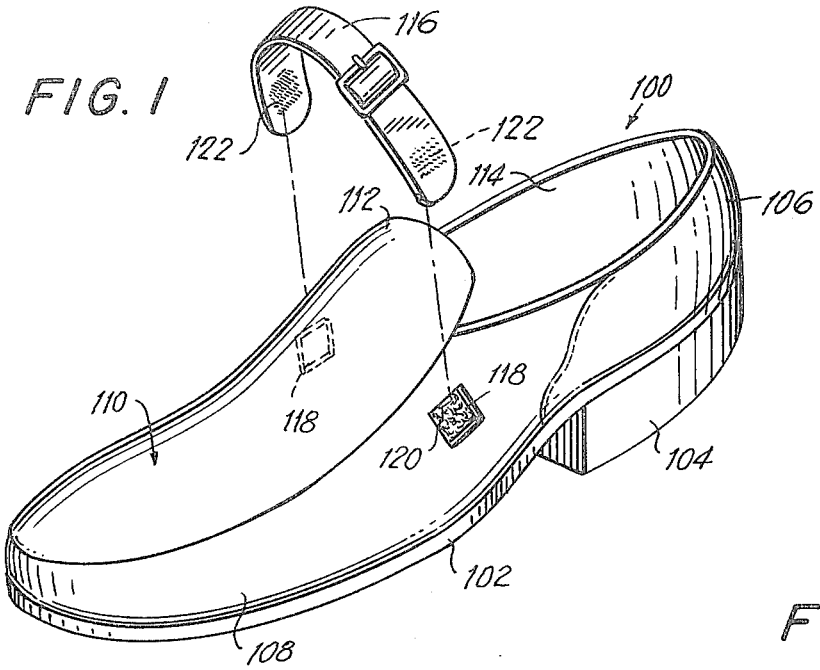
FIG. 1 is a perspective exploded view of a shoe construction in accordance with the invention.

Referring now to FIG. 1, the embodiment of the invention depicted includes a shoe 100 of the blucher moccasin or slip-on type provided with a sole 102 supporting a heel 104 projecting downwardly therefrom on the rearward portion of said sole. A counter 106 projects upwardly from the rearward periphery of sole 102. The vamp of the shoe is defined by a vamp portion 108 extending upwardly from the forwardly portion of the periphery of sole 102 and a plug portion 110 bridging the upper periphery of vamp portion 108. As taught in my co-pending application Ser. No. 554,277, plug portion 110 may represent a separate plug portion secured at its periphery to vamp 108 or it may represent a removable plug releasably secured at its periphery to vamp 108 by means of a zipper or the like, or it may represent a plug cover releasably secured to the top surface of an underlying plug member which, itself, may be either fixedly or releasably secured to the upper periphery of plug portion 108. Plug portion 110 is provided with a tongue region 112 which will overlie the instep region of the wearer of the shoe construction. Interior of the counter 106 and vamp portion 108 is an inner lining 114 of a material suitable for engagement with the foot of the wearer of the shoe.

Figure 3:
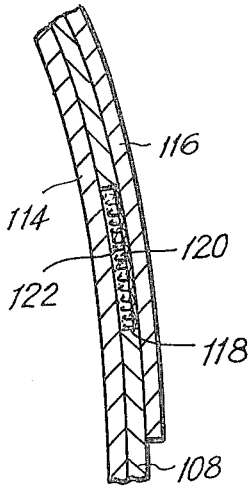
FIG. 3 is a sectional view taken along lines 3—3 of FIG. 2.

It is desirable to provide, as ornamentation, an ornamental member 116 which, in the embodiment depicted, is in the form of a simulated buckle, but may take any other desired form including simulated laces, tassels, or other ornaments. In order to releasably secure the ornamental member 116 to the footwear construction 100, a window 118 is formed on opposing sides of vamp portion 108 and suitable securing means is retained intermediate lining 114 and vamp portion 108 so as to be accessible through windows 118. In one embodiment, the securing means in windows 118 comprises the loop portions 120 of a hook and loop fastener, the hook portions 122 being secured to the underside of ornamental member 116 at respective positions for registration with windows 118, and therefor loop portions 120. The hook and loop fasteners are characterized by the capability of secured retention of the ornamental member when the hooks are forced into the loops as depicted in FIG. 3, which secure engagement is releasable. The hook and loop fastener portions 120 and 122 are provided in tape form and may be readily secured by adhesives, stitching or the like to the respective lining 114 and ornamental member 116. If desired, windows 118 may be dispensed with and loop portions 120 may be affixed to the exterior surface of vamp portion 108. The loop portion is available in a plurality of colors and may be selected to blend with the color of the vamp portion 108.

In application, a pair of footwear in accordance with FIG. 1 may be sold with a plurality of interchangeable ornamental members 116, creating different ornamental effects or of different colors. The various ornamental members may be interchangeable in coordination with interchangeable plug covers or plug members as taught in my co-pending application. By standardizing the spacing between windows 120 for a range of shoe sizes, a single ornamental member may be adapted to coordinate with a plurality of shoe sizes.

Figure 4:
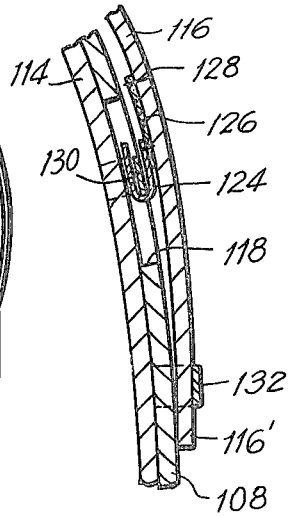
FIG. 4 is a sectional view corresponding to the cross-section of FIG. 3 depicting an alternate embodiment of the arrangement in accordance with the invention.

Referring now to FIG. 4, an alternate arrangement for releasably securing the ornamental member 116 to the footwear construction is depicted, like reference numerals being applied to like elements. In the embodiment of FIG. 4 one of two hooks 124 is secured to one of two corresponding elastic members 126, each of which is in turn secured, as by stitching 128, to one end of ornamental member 116. A mating hook member 130 in the nature of an eye is secured within each window 118 to lining 114 for receipt of a corresponding hook 124. In the alternative, hooks 124 may be fixably secured to ornamental member 116 and eyes 130 may be secured to an elastic member which is in turn secured to lining 114. The provision of the elastic provides some relief from the tolerance requirements of manufacture and also ensures a snug retention of the ornamental member so as to bridge the tongue or instep region of the footwear construction. In the embodiment depicted in FIG. 4, a further loop member 132 is secured to vamp portion 108 for receiving the ends 116' of ornamental member 116 for aiding in the retention thereof.

Figure 5:
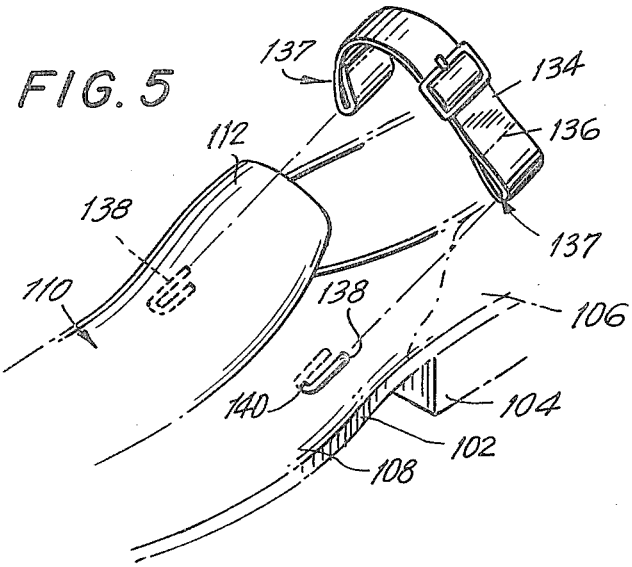
FIG. 5 is a fragmentary exploded perspective view of an alternate embodiment of the footwear construction in accordance with the invention.
Figure 5A:
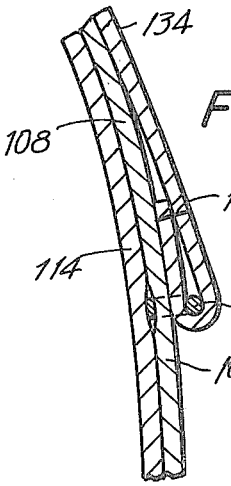
FIG. 5a is a sectional view corresponding to the cross-section of FIG. 3 depicting the embodiment of FIG. 5.

Still a further means for releasably securing an ornamental member to a footwear construction is depicted in FIGS. 5 and **5*a* where like reference numerals are applied to like elements. In this embodiment, the ends of the ornamental 134 are folded inwardly and secured as by stitching 136 to define loop regions 137 for receiving bar-shaped hook members 138 secured to and projecting rearwardly from vamp portion 108. Hook member 138 is depicted as being in the form of a U-shaped member extending through aperture 140 in vamp portion 108, one arm of which cooperates with a loop region 137 of the ornamental member, the other arm of which is retained between lining 114 and vamp portion 108.**

Figure 2:
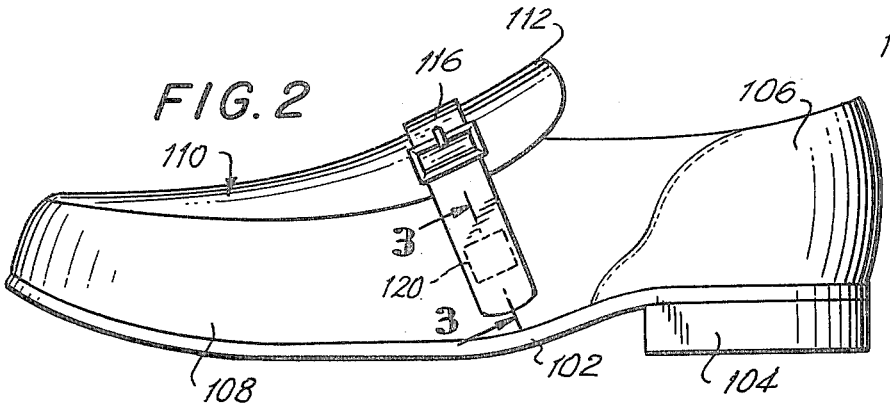
FIG. 2 is a side elevational view of the shoe construction of FIG. 1.
Figure 6:
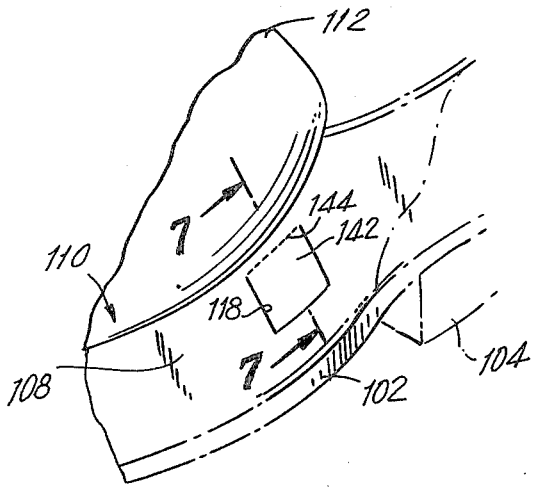
FIG. 6 is a fragmentary perspective view of still another embodiment of the footwear construction.
Figure 7:
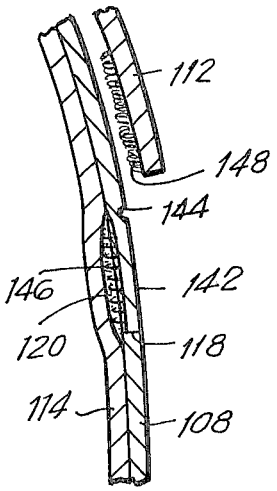
FIG. 7 is a sectional view taken along line 7—7 of FIG. 6.
Figure 8:
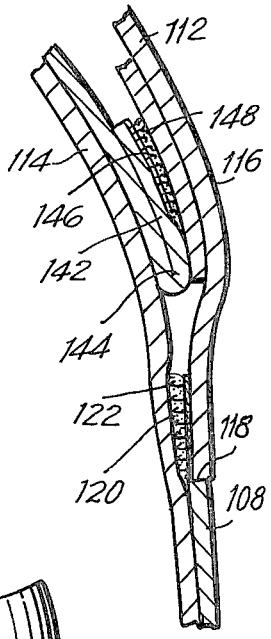
FIG. 8 is a sectional view corresponding to the cross-section of FIG. 7 depicting the shoe construction of FIG. 6 incorporating an ornamental member in accordance with the invention.

Referring now to FIGS. 6–8, still another embodiment of the footwear construction in accordance with the invention is depicted, like reference numerals being applied to like elements. The embodiments of FIG. 6 is similar in construction to the embodiment of FIGS. 1–3 except that window 118 is defined by a flap 142 formed in vamp 108 and foldable in any upwardly direction along score line 144. As in the case of the embodiment of FIGS. 1–3, the loop portion 120 of a loop and hook fastener is retained within the window 118 between lining 114 and vamp portion 108. However, in the embodiment of FIGS. 6–8, loop portion 120 is shielded from view by the flap 142. In order to hold flap 142 closed, a hook portion 146 is secured to the inner surface of each flap 142 for cooperation with loop portion 120 to define a hook and loop fastener. This permits the wearing of the shoe construction of FIG. 6 without any ornamental member, if desired. If it is desired to use an ornamental member, each flap 142 is folded back and the respective hook portion 146 engages against and cooperates with a corresponding loop portion 148 secured on the underside of tongue 112. As shown in FIG. 8, an ornamental member 116 provided with hook portions 122 is then positioned for cooperation with hook portions 120 to provide the desired ornamental effect. Hook and loop portions as depicted can be interchanged provided that in each orientation of the flaps 142, a hook portion mates with a loop portion.

Figure 9:
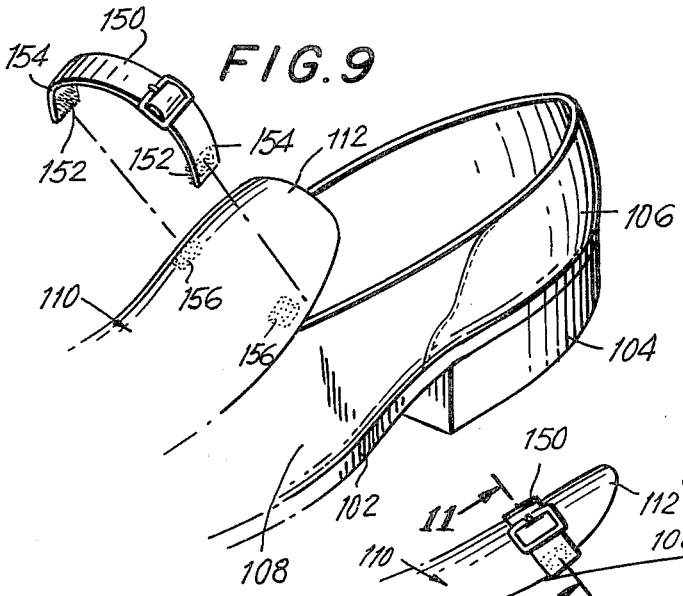
FIG. 9 is a fragmentary exploded perspective view of still another embodiment of the footwear construction in accordance with the invention.
Figure 10:
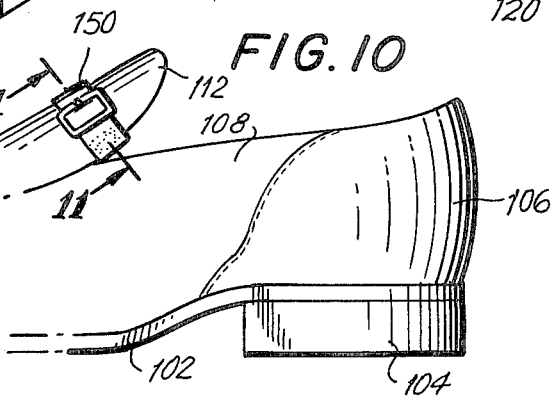
FIG. 10 is a side elevational view of the footwear construction of FIG. 9.
Figure 11:
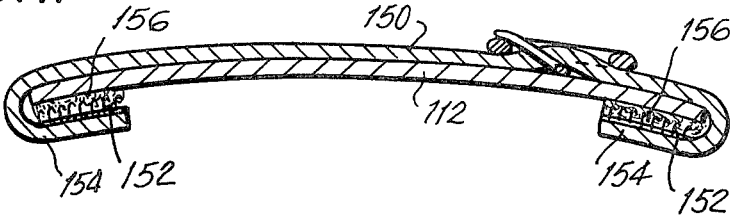
FIG. 11 is a sectional view taken along line 11—11 of FIG. 10.

Turning now to FIGS. 9–11, still another embodiment of the footwear construction in accordance with the invention is depicted, like reference numerals being applied to like elements. In the embodiment of FIGS. 9–11, the ornamental member 150 is provided with hook portions 152 of a hook and loop fastener at the ends 154 thereof. Ends 154 of ornamental member 150 are adapted to fold around the free side edges of tongue portion 112 and under said tongue portion of plug portion 110 for cooperation with the loop portions 156 secured to the underside of tongue 112 at spaced side regions thereof. In this manner, a plurality of ornamental members 150 can be releasably secured to the tongue portion to create the desired ornamental effect.

The releasably secured ornamental members described above can be utilized with any footwear construction and are not limited in their application to footwear constructions of the blucher moccasin or slip-on type or to footwear constructions having removable plugs, separate plugs or plug covers, although they can be used coordinate with such removable plugs, separate plugs or plug covers if desired.

The footwear constructions in accordance with the invention are characterized by increased sightliness and marketability by reason of the flexibility which they provide both the manufacturer and user. Ornamental members of different colors and designs may be readily and interchangeably secured to shoes whereby a variety of style and color effects are easily attained.

It will thus be seen that the objects set forth above among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A footwear construction comprising a sole portion, a counter portion extending substantially upwardly from the rearward periphery of said sole portion, vamp means extending upwardly from the forward peripheral region of the sole portion and defining the instep region of the footwear construction, an ornamental member for overlying the instep region, releasable securing means having a first portion on said vamp means and a second portion on said ornamental member for cooperatively releasably securing said ornamental member to the vamp means, said ornamental member being dimensioned to bridge said instep region and at least in part overlie regions of said vamp means on opposed sides of said instep region, and window means formed in said regions of said vamp means on opposed sides of said instep region, said first portion of said securing means being positioned within said window means, each of said window means being defined by a cut-out region of said vamp means, said footwear construction including lining means for retaining said first portion of said securing means within said window means whereby a plurality of said ornamental members may be interchangeably applied to said footwear construction.

2. A footwear construction as recited in claim 1, wherein said plug portion includes a rearwardly projecting tongue portion in the instep region thereof, said window openings being positioned so that the flaps defining same each extend, at least in part, beneath said tongue portion when in their respective open positions, said footwear construction including at least two further of the one of the hook elements and loop elements of the type within said window means, said further of said one of said hook elements and loop elements being respectively affixed to the underside of said tongue portion in cooperative registration with the corresponding of said further of said other of said hook elements and loop elements secured to the underside of said flaps when said flaps are folded upwardly in their respective open positions.

3. A footwear construction as recited in claim 1, wherein said securing means comprises hook and loop securing means having hook elements and loop elements, one of said hook elements and loop elements being disposed in each of said window means the other said hook element and loop elements being affixed to respective regions of the underside ornamental member.

4. A footwear construction as recited in claim 1, wherein said first portion of said releasable securing means is one of a hook element and an eye element of a hook and eye securing means, said second portion of said releasable securing means defining the other of said hook element and eye element.

5. A footwear construction as recited in claim 4, wherein said releasable securing means further includes at least one elastic member, one of said hook and eye elements being secured to one side of said elastic member, the other side of said elastic member being secured to one of said vamp portion and ornamental member.

6. A footwear construction as recited in claim 1, wherein said vamp means includes a vamp portion extending substantially upwardly from the forwardly peripheral region of the sole portion and a plug portion dimensioned to substantially bridge the upper periphery of the vamp portion, said plug portion defining at least in part the instep region of the footwear construction said ornamental member being dimensioned to bridge said plug member and at least in part overlie regions of said vamp portion on opposed sides of said instep region, said window means being positioned on said regions of said vamp portion.

7. A footwear construction comprising a sole portion, a counter portion extending substantially upwardly from the rearward periphery of said sole portion, vamp means extending upwardly from the forward peripheral region of the sole portion and defining the instep region of the footwear construction, an ornamental member for overlying the instep region, releasable securing means having a first portion on said vamp means and a second portion on said ornamental member for cooperatively releasably securing said ornamental member to the vamp means, said ornamental member being dimensioned to bridge said instep region and at least in part overlie regions of said vamp means on opposed sides of said instep region, and window means formed in said regions of said vamp means on opposed sides of said instep region, said first portion of said securing means being positioned within said window means, said window means being defined by a flap of the material defining said vamp means, said flap normally closing said window means and being displaceable upwardly to an open position to expose the first portion of the securing means positioned within said window means whereby a plurality of said ornamental members may be interchangeably applied to said footwear construction.

8. A footwear construction as recited in claim 7, wherein said securing means comprise hook and loop securing means having hook elements and loop elements, one of said hook and loop elements being disposed in each of said window means the other of said hook and loop elements being affixed to respective regions of the underside of said ornamental member.

9. A footwear construction as recited in claim 8, wherein the first portion of said securing means within said window is one of said hook elements and loop elements, and including a further of the other of said hook elements and loop elements affixed to the underside of each said flap for retaining each said flap in its closed position by the cooperation of the first portion of said securing means and said further of said other of said hook elements and loop elements.

10. A footwear construction comprising a sole portion, a counter portion extending substantially upwardly from the rearward periphery of said sole portion, vamp means extending upwardly from the forward peripheral region of the sole portion and defining the instep region of the footwear construction, an ornamental member for overlying the instep region and releasable securing means having a first portion on said vamp means and a second portion on said ornamental member for cooperatively releasably securing said ornamental member to the vamp means, said vamp means being provided with a rearwardly projecting tongue portion defining the instep region thereof and having free side edges, said ornamental member being dimensioned to bridge the top surface of said tongue portion and to extend around the respective free side edges of said tongue portion to the underside of said tongue portion, said first portion of said releasable securing means being affixed to the underside of said tongue portion whereby a plurality of said ornamental members may be interchangeably applied to said footwear construction.

11. A footwear construction as recited in claim 10, wherein the first portion of said releasable securing means is one of hook elements and loop elements of a hook and loop securing means, the second portion of said releasable securing means including the other of said hook elements and loop elements.

12. A moccasin slip-on type footwear construction comprising a sole portion; a counter portion extending upwardly from the rearwardly peripheral region of said sole portion; exposed vamp portion means extending upwardly from the forwardly peripheral region of said sole portion; separate plug means dimensioned to substantially bridge the upper periphery of said vamp portion means and overlie the forwardly region of said sole portion; means for securing said plug means to said vamp portion means; plug cover means; hook and loop fastener means releasably securing said plug cover means to the upper surface of said plug means, said plug cover means being dimensioned to overlie the hook and loop fastener means between said plug cover means and said plug to shield same from view; an ornamental member dimensioned to bridge said plug means and at least in part overlie regions of said vamp portion on opposed sides of said plug means, and further releasably securing means having a first portion in said regions of said vamp portion and a second portion on said ornamental member for cooperatively releasable securing said ornamental member to the vamp means, whereby a plurality of said plug cover means and said ornamental members may be interchangeably applied to said footwear construction to produce a plurality of ornamental effects.

13. A footwear construction as recited in claim 12, wherein said further releasable securing means are hook and loop securing means.

14. A footwear construction as recited in claim 12 wherein said further releasable securing means are hook and eye securing means.

15. A footwear construction as recited in claim 14 wherein said further releasable securing means further includes at least one elastic member, said hook and eye securing means including at least one hook and one eye element, at least one of said hook and eye elements being secured to one side of said elastic member, the other side of said elastic member being secured to one of said vamp portion and ornamental member.

* * * * *